US005122312A

United States Patent [19]

Tomalesky

[11] Patent Number: 5,122,312

[45] Date of Patent: Jun. 16, 1992

[54] BUBBLE INJECTION SYSTEM

[75] Inventor: Stanley G. Tomalesky, Plantsville, Conn.

[73] Assignee: Mott Metallurgical Corporation, Farmington, Conn.

[21] Appl. No.: 664,776

[22] Filed: Mar. 5, 1991

[51] Int. Cl.[5] ..... B01F 3/04

[52] U.S. Cl. ..... 261/122; 261/124

[58] Field of Search ..... 261/122, 124

[56] References Cited

U.S. PATENT DOCUMENTS

| | | | |
|---|---|---|---|
| Re. 13,684 | 2/1914 | Heslewood | 261/122 |
| 2,479,403 | 8/1949 | Powers | 261/124 |
| 3,927,152 | 12/1975 | Kyrias | 261/122 |
| 4,117,048 | 9/1978 | Stockner et al. | 261/124 |
| 4,177,226 | 12/1979 | Danel | 261/124 |
| 4,215,082 | 7/1980 | Danel | 261/124 |
| 4,897,204 | 1/1990 | Katoh et al. | 261/122 |
| 4,992,216 | 2/1991 | Saita et al. | 261/122 |

FOREIGN PATENT DOCUMENTS

| | | | |
|---|---|---|---|
| 583849 | 9/1933 | Fed. Rep. of Germany | 261/122 |
| 694918 | 7/1953 | United Kingdom | 261/122 |

*Primary Examiner*—Tim Miles

*Attorney, Agent, or Firm*—Chilton, Alix & Van Kirk

[57] ABSTRACT

A bubble injection system for forming and distributing micron size gas bubbles in a body of liquid at the point of use of the bubble distribution comprising an axially extending inner fluid conduit forming an axially extending liquid flow channel and a concentric outer fluid conduit extending axially along the inner conduit and spaced therefrom. An outer gas channel is defined by the conduits and includes a plurality of porous outlets extending thereacross from the inner conduit to the outer conduit. The porous outlets terminate in outlet jet ports spaced along the outer conduit whereby gas flowing through the gas channel will penetrate the porous tubular outlets to form gas bubbles and liquid floring through the liquid conduit and outlets will sweep the gas bubbles from the surface of the outlets toward and out of said jet ports for immediate dispersion of the body of liquid.

11 Claims, 2 Drawing Sheets

BUBBLE INJECTION SYSTEM

BACKGROUND AND SUMMARY OF THE INVENTION

The present invention relates generally to systems for mixing gases and liquids and is more particularly concerned with a new and improved bubble injection system for forming and distributing bubbles in a body of liquid.

For some time spargers have been used as a means of dispersing gases in liquids for various purposes, such as heating large amounts of liquid using live steam, or maintaining constant agitation of the liquid in foam flotation processes using compressed air or gas. A sparger generally consists of a pipe having a plurality of small perforations or nozzles spaced at regular intervals along its length. The pipe typically is submerged in the liquid to be treated and gas is introduced into the pipe and forced to bubble through the holes or nozzles therein into the liquid. While this type of sparger is relatively inexpensive, it is not capable of producing very fine bubbles or of providing a broad and uniform distribution of the bubbles within the liquid body. In order to accomplish this, it is frequently necessary to further agitate the liquid mass thereby significantly increasing the cost of the equipment and the energy expended in order to provide the desired bubble distribution.

Smaller or finer size bubbles can be generated in a liquid stream in an energy efficient manner by the use of porous metal tubing positioned within a conduit through which the liquid passes. The gas is pumped though the porous wall of the tube while the liquid flows therealong. The bubbles formed in the liquid at the wall of the porous metal tubing are drawn away from the wall and are carried with the flowing liquid to their point of use, typically at a remote location from the point of bubble formation. Unfortunately, the small bubbles entrained within the liquid tend to combine forming larger bubbles and also tend to separate from the liquid when any attempt is made to convey the bubble/liquid mixture to a location remote from its point of origin. Thus, the distribution of very fine bubbles over a large area is extremely difficult.

It has been found in accordance with the present invention, that the aforementioned problems and difficulties can be resolved by the utilization of a bubble injection system that combines the beneficial aspects of the prior techniques while avoiding the draw backs thereof. This is achieved through the use of a system employing separate conduits having a plurality of porous tubular outlets forming jet ports at spaced intervals along the conduits whereby the gas and liquid phases are isolated from each other until just before they reach their point of use. At that location they are combined to form micron size bubbles at the jet ports and the liquid/-bubble mix is immediately injected into the body of liquid being treated. The system of the present invention specifically comprises an axially extending inner liquid carrying conduit, a concentric outer conduit extending axially along the inner conduit and spaced therefrom to provide a gas channel therebetween and a plurality of porous tubular outlets extending generally radially from the inner conduit to the outer conduit across the gas channel and terminating in outlet jet ports that are spaced along the longitudinal extent of the outer conduit. The inner conduit defines an axially extending liquid flow channel that directly communicates with the jet ports through the outlets so that when the gas flowing through the gas channel penetrates the porous tubular outlets to initiate the formation of gas bubbles on the walls of the outlets, the liquid flowing through the liquid conduit and outlets will strip the partially formed gas bubbles from the surface of the outlets and sweep them out of the jet ports for immediate dispersion within the body of liquid being treated.

Bubble injection systems of the type described are particularly well suited for use in chemical reactors, gas flotation apparatus for ore separation, the processing of precious metals, coal flotation processes, for the introduction of air into bacterial reactors, fish farming ponds and the like and sewage treatment facilities. The effectiveness of the system of the present invention relies upon the separation of the gas and liquid phases until immediately prior to the point of injection of the bubbles into the system and the utilization of ultrafine or micron size gas bubbles resulting from the stripping or shearing of the bubbles from the porous outlet surfaces before full bubble formation has been achieved. These features coupled with control of both the liquid and gas pressure as well as the diameter of the jet ports facilitate improved dispersion of the micron size gas bubbles throughout the entire body of treated liquid. Further, the simplicity of the design significantly enhances heat transfer and reduces installation and maintenance cost while permitting extensive flexibility therein.

Other advantages and features will be in part obvious and in part pointed out more in detail hereinafter.

A better understanding of the objects, advantages, features, properties and relationships of the invention will be obtained from the following detailed description and accompanying drawings which set forth an illustrative embodiment and are indicative of the way in which the principles of the invention are employed.

DESCRIPTION OF A PREFERRED EMBODIMENT

Figure 1:
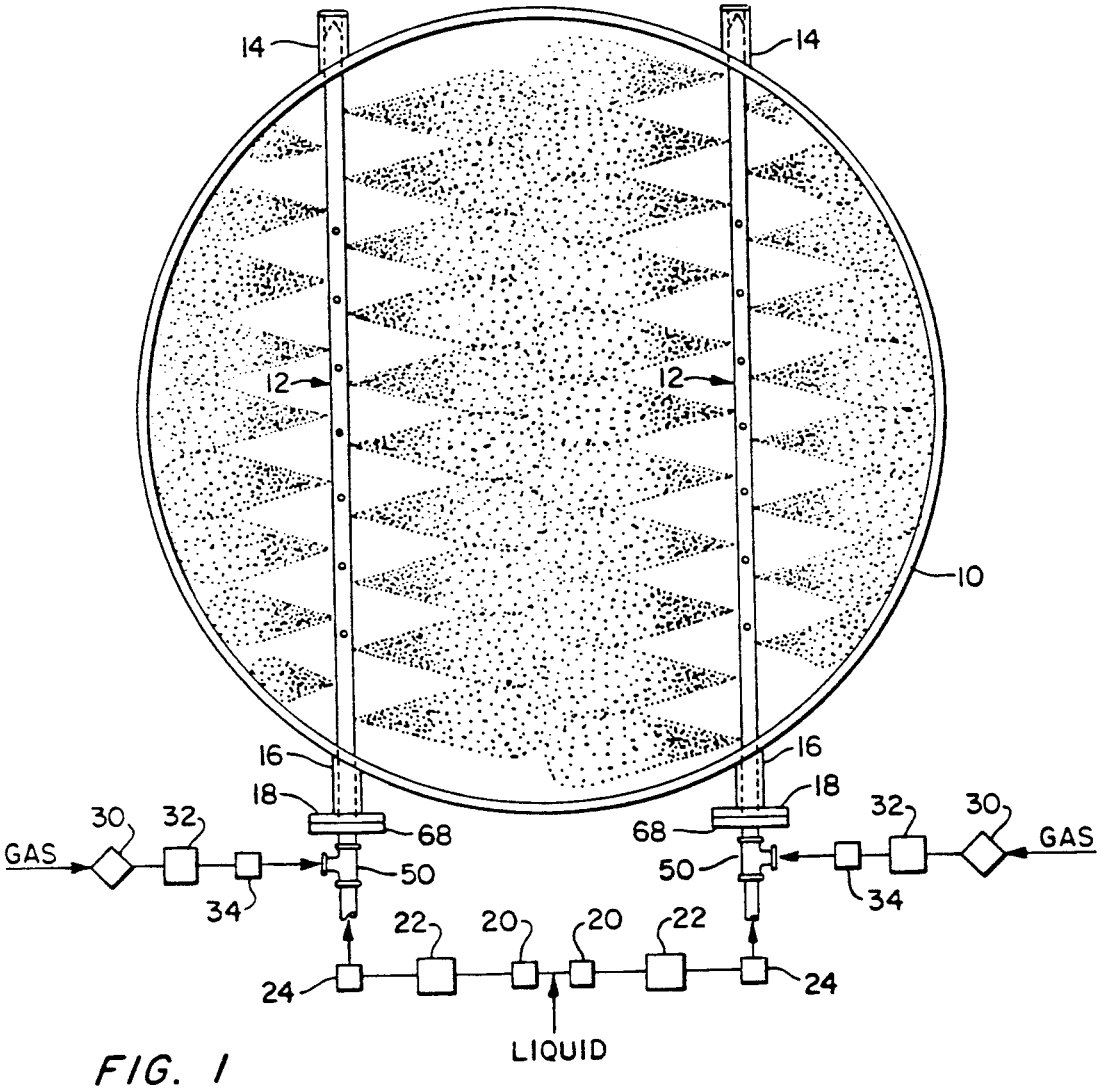
FIG. 1 is a top plan view of the lower portion of a liquid treatment tank utilizing the bubble injection system of the present invention.

Referring now to the drawings in greater detail wherein like reference numerals indicate like parts throughout the several figures, a treating tank 10 for holding a body of liquid to be treated is shown as being provided with a pair of bubble injector assemblies 12 for injecting and fully distributing a pattern of micron size bubbles throughout the base area of the treatment tank, as shown in FIG. 1. The tank 10 is shown as being provided with two pairs of aligned injector mounting sleeves affixed to and extending outwardly from the wall of the tank, one pair for each injector assembly. Alternative arrangements can be employed with good success. One such sleeve of each pair, the terminal sleeve 14, is closed at its outermost end and is adapted to receive the capped distal end of the injector assembly 12. The opposite or entrance sleeve 16 is provided with an outwardly extending mounting flange 18 on the free end thereof for securing the injector assembly 12 in its fixed mounted position on the tank. As will be appreciated, other modes of mounting the injectors on or within the tank may be readily employed without departing from the teachings of the present invention.

As shown, the injector assembly 12 extends through the entrance sleeve 16, passes through the wall of the treatment tank 10 at the respective sleeves and comes to rest within the terminal sleeve 14 so as to position the jet ports carried thereby within the interior of the tank enclosure for providing the desired bubble plume array within the tank. The downstream or distal end of the assembly 12 need not be fixedly secured to the tank wall or the sleeve 14 since the upstream end thereof is secured by the radial flange 18 of the entrance sleeve 16. The assembly 12 extends outwardly beyond the sleeve 16 for connection to suitable liquid and gas supply lines, as indicated. For example, liquid flow may be controlled by a suitable flow control valves 20 before passing through appropriate meters 22. A one way check valve 24 may be incorporated for preventing reverse flow away from the assembly 12. The gas supply line may conveniently have a filter 30 and flow control unit 32 for the gas before passing through its check valve 34 into the assembly 12. Other suitable arrangements may be employed.

Figure 3:
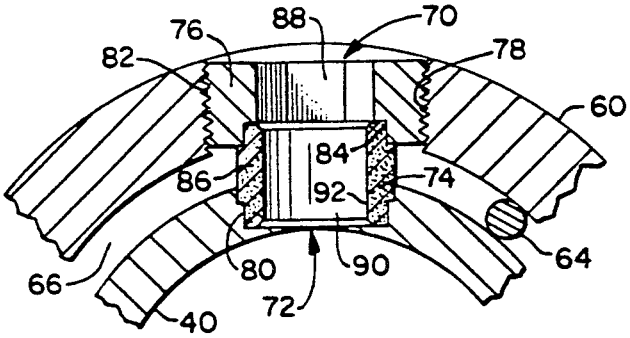
FIG. 3 is a further enlarged sectional view of the porous bubble forming tubular outlet and jet port of the conduit assembly, taken along the line 3-3 of FIG. 2.
Figure 2:
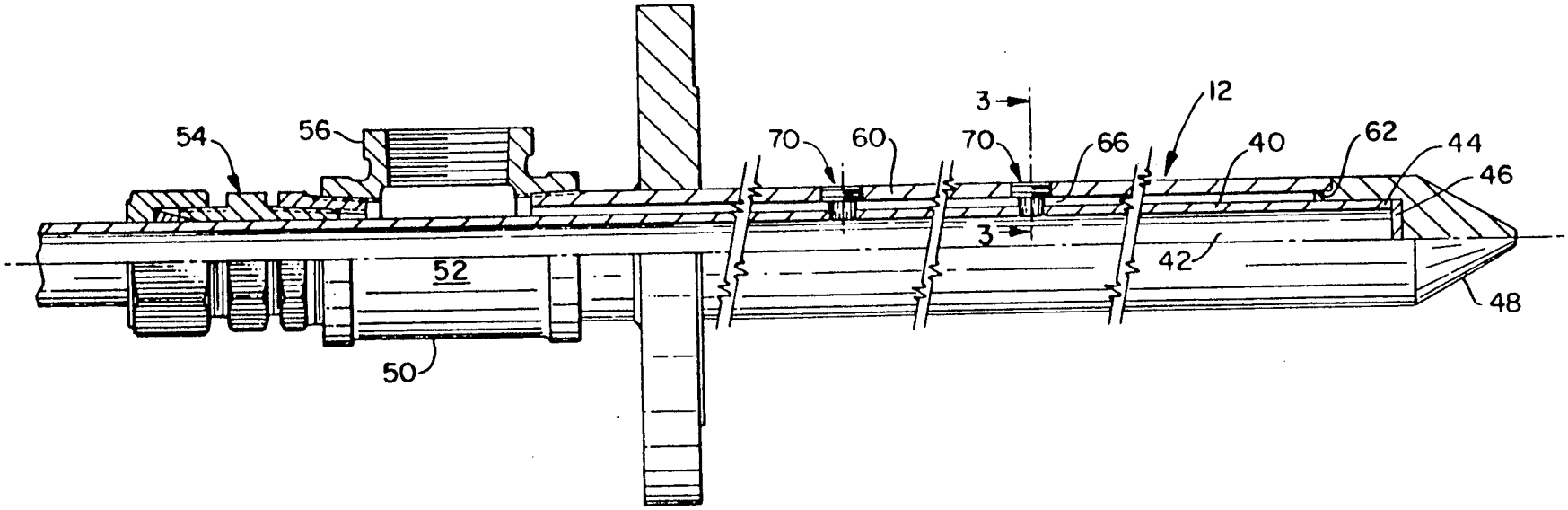
FIG. 2 is an enlarged fragmentary plan view, partially broken away and partially in section, of the bubble forming and distributing conduit assembly of the system shown in FIG. 1.

Referring now to FIG. 2, the injector assembly 12 consists of an elongated tubular inner sleeve or conduit 40 defining a central liquid supply channel 42 of circular cross-section. The channel 42 is terminated at the distal end 44 of conduit 40 by an appropriate flat cover 46 over which is mounted a tapered end cap 46 to facilitate insertion of the distal end of the assembly 12 into the terminal sleeve 14 of the treating tank 12. Adjacent the opposite or inlet end of conduit 40, there is mounted a T-shape gas connector 50 having a main portion 52 that concentrically circumscribes the conduit 40 and is secured in space relationship thereto by means of a wedging locknut connection assembly 54. The side branch 56 of the T-connector 50 may be threaded or otherwise adapted for connection to the gas supply line of the system. A concentric outer conduit 6? extending from the main portion 52 of the T-shape connector 50 to the end cap 48, encloses the inner conduit 40 along substantially the full length thereof. The outer conduit 60, at one end, rest upon a shoulder 62 in the end cap 48 and is affixed at its opposite end via a threaded connection to the main portion 52 of the T-shape connector 50. Spacers 64, as shown in FIG. 3, may be effectively employed to maintain a substantially uniform spaced relationship between the inner and outer conduits and thereby assist in defining an annular gas channel 66 between the conduits extending along substantially the full length of the injector assembly 12. Between the end cap 4B and the T-shaped gas connector 50 but substantially adjacent the connector, the outer conduit 60 is further provided with a mounting ring 68 appropriately secured thereto and adapted to cooperate with the radial flange 18 on the entrance sleeve 16 of the treating tank 10. The ring 68 and flange 18 can be secured by suitable means that will permit ready disassembly between the injector assembly 12 and the tank 10 for maintenance, repair or adjustment.

Spaced along the injector assembly between the ring 68 and end cap 48 are a series of jet ports 70 that can be varied in number, size and direction to provide the desired bubble plumb array suited to the particular application. As best shown in FIG. 3, each jet port 70 is provided with a bubble generating assembly generally designated 72 and consisting of a cylindrical porous bushing 74 coaxially mounted on a pressure plug 76 having a slightly tapered threaded exterior peripheral surface 78. The bubble generating assembly 72 is received within coaxially aligned apertures 80, 82 in the inner and outer conduits 40, 60, respectively. The porous bushing 74 preferably is a sintered metal tubular member with one end seated within the aperture 80 of the inner conduit 40 while the opposite end thereof is securely seated within an appropriate counterbore or recess 84 in the pressure plug 76. The midportion 86 of bushing 74 fully traverses the gas channel 66 defined by the inner and outer conduits. The pressure plug 76 is provided with a hexagonally shaped central aperture 88 coaxially aligned with the slightly smaller bubble injection channel 90 defined by the inner surface 92 of the porous bushing 80. The hexagonal configuration of the aperture 88 facilitates the rapid threaded assembly of the pressure plug 76 within the threaded aperture 82 of the outer conduit 60, while at the same time snugly seating the innermost end of the porous bushing 74 within the aperture 80 of the inner conduit 40.

In operation, pressurized gas or air flows through the gas inlets of the injection system and travels along the gas channel 66 defined by the inner and outer conduits at a pressure up to about 100 psi. While the gas pressure can be adjusted to suit the specific operation desired, typically it is greater than the pressure exerted by the liquid passing through the assembly by a factor of about one to five times. The liquid passes through the central channel 42 of the inner conduit 40 and, upon reaching the bubble generating assembly 72, passes through channels 90 and 88 before exiting through the jet port 70. The gas under pressure penetrates through midportion 86 of porous bushing 74 and forms micron size bubbles adhered to the inner surface 92 of the bushing. The flow of liquid through central channel 90 of the bushing sweeps the inner walls 92 thereof, stripping the micron size bubbles from the wall and driving them out of the jet ports 70 into the main body of liquid located within the tank 10. The mass or plume of very fine bubbles provides an exceptionally high liquid gas interface area for concentrating minerals by the froth flotation process or for coal or mineral separation or the like.

As will be apparent to a person skilled in the art, various modifications, adaptations and variations of the foregoing specific disclosure can be made without departing from the teachings of the present invention.

I claim:

1. A bubble injection system for forming and distributing micron size gas bubbles in a body of liquid at the point of use of the bubble distribution comprising an inner fluid conduit forming a liquid flow channel, an outer fluid conduit extending axially along said inner conduit and spaced therefrom to provide a gas channel therebetween, and a plurality of porous bubble generating outlet assemblies extending from said inner conduit to said outer conduit wherein said porous bubble generating outlet assemblies consist of a porous bushing and mounting plug, said bushing being a sintered metal tubular member having a bubble injection channel extending across the gas channel and secured to the mounting plug, said assemblies terminating in outlet jet ports spaced along said outer conduit whereby gas flowing through said gas channel will penetrate said bubble generating assemblies to form micron size gas bubbles within said outlets and liquid flowing through said liquid flow channel and outlets will sweep said gas bubbles from the surface of said outlets toward and out of said jet ports for immediate dispersion in said body of liquid.

2. The system of claim 1 wherein said mounting plug has a central aperture connecting the bubble injection channel and one of said jet ports.

3. The system of claim 2 wherein said mounting plug includes fastening facilitating means for facilitating rapid attachment of said plug to one of said conduits.

4. A bubble injection system for forming and distributing micron size gas bubbles in a body of liquid at the point of use of the bubble distribution comprising an inner fluid conduit forming a liquid flow channel, an outer fluid conduit extending axially along said inner conduit and spaced therefrom to provide a gas channel therebetween, wherein said gas channel is an annular channel and a plurality of porous bubble generating outlet assemblies extending from said inner conduit to said outer conduit across said gas channel and terminating in outlet jet ports spaced along said outer conduit whereby gas flowing through said gas channel will penetrate said bubble generating assemblies to form micron size gas bubbles within said outlets and liquid flowing through said liquid flow channel and outlets will sweep said gas bubbles from the surface of said outlets toward and out of said jet ports for immediate dispersion in said body of liquid.

5. The system of claim 4 wherein said porous bubble generating outlet assemblies include a sintered tubular member extending across the gas channel and having an axially extending bubble injection channel extending therethrough.

6. The system of claim 4 wherein said outer conduit overlies said inner conduit along its length to form said gas channel and said porous outlet assemblies extend substantially radially between said conduits and through said gas channel.

7. The system of claim 4 wherein said porous bubble generating outlet assemblies include a porous bushing of sintered metal having a midportion extending across the gas channel with one end portion mounted on said inner conduit and the opposite end portion communicating with one of said jet ports.

8. The system of claim 7 wherein said bushing is a tubular member having an axially extending bubble injection channel extending through said midportion.

9. A bubble injection system for forming and distributing micron size gas bubbles in a body of liquid at the point of use of the bubble distribution comprising an inner fluid conduit forming a liquid flow channel, and outer fluid conduit extending axially along said inner conduit and spaced therefrom to provide a gas channel therebetween, wherein said outer conduit is concentric with said inner conduit along its length to form said gas channel as an annular channel, and a plurality of porous bubble generating outlet assemblies extending from said inner conduit to said outer conduit across said gas channel and terminating in outlet jet ports spaced along said outer conduit, said porous outlet assemblies extending substantially radially between said conduits and including a sintered metal member having a midportion extending across the gas channel whereby gas flowing through said gas channel will penetrate said bubble generating assemblies to form micron size gas bubbles within said outlets and liquid flowing through said liquid flow channel and outlets will sweep said gas bubbles from the surface of said outlets toward and out of said jet ports for immediate dispersion in said body of liquid.

10. The system of claim 9 including spacers in the gas channel maintaining separation of said conduits.

11. The system of claim 9 wherein said porous outlet assemblies consist of a porous bushing and mounting plug, said bushing being a sintered metal member extending across the gas channel with one end portion mounted on one of said conduits and the opposite end portion secured to said mounting plug.

* * * * *